US007409178B2

(12) United States Patent
Yokono

(10) Patent No.: US 7,409,178 B2
(45) Date of Patent: Aug. 5, 2008

(54) COLOR LASER PRINTER AND DETACHABLE TRANSFER BELT UNIT FOR CORRECTING COLOR AND POSITION DIFFERENCE

(75) Inventor: Masaharu Yokono, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 10/666,255

(22) Filed: Sep. 22, 2003

(65) Prior Publication Data

US 2004/0057737 A1 Mar. 25, 2004

(30) Foreign Application Priority Data

Sep. 20, 2002 (JP) ..... 2002-275659

(51) Int. Cl.
*G03G 15/08* (2006.01)

(52) U.S. Cl. ..... 399/121; 399/301

(58) Field of Classification Search ..... 399/40, 399/66, 13, 36, 31, 121, 299, 301, 394–396, 399/12, 38; 347/116
See application file for complete search history.

(56) References Cited

U.S. PATENT DOCUMENTS 5,452,073 A * 9/1995 Kataoka ..... 399/299
5,579,092 A * 11/1996 Isobe et al. ..... 399/39
5,754,195 A 5/1998 Yokono
6,198,897 B1 * 3/2001 Ream ..... 399/301
6,363,228 B1 * 3/2002 Ream ..... 399/66
6,661,981 B2 * 12/2003 Boothe et al. ..... 399/44
6,842,602 B2 * 1/2005 Kudo ..... 399/303
7,197,256 B2 * 3/2007 Nishizaki ..... 399/66

FOREIGN PATENT DOCUMENTS

JP 07036249 A * 2/1995
JP 7-199576 8/1995
JP 08204900 A * 8/1996
JP 09175687 A * 7/1997
JP 10213943 A * 8/1998
JP 11024498 A * 1/1999
JP 11344875 A * 12/1999
JP 2001318573 A * 11/2001

OTHER PUBLICATIONS

U.S. Appl. No. 11/284,943, filed Nov. 23, 2005, Washio et al.

* cited by examiner

*Primary Examiner*—Robert Beatty
(74) *Attorney, Agent, or Firm*—Oblon, Spivak, McClelland, Maier & Neustadt, P.C.

(57) ABSTRACT

A color laser printer includes a transfer belt unit including a transfer belt with reference marks, and a drive mechanism for the transfer belt, wherein the transfer belt unit includes a data storage unit (EEPROM) that stores color correction data and position correction data. When the transfer belt unit is new or replaced, corrections for color difference and position difference are performed based on the color correction data and the position correction data.

9 Claims, 5 Drawing Sheets

COLOR LASER PRINTER AND DETACHABLE TRANSFER BELT UNIT FOR CORRECTING COLOR AND POSITION DIFFERENCE

BACKGROUND OF THE INVENTION

1) Field of the Invention

The present invention relates to a technology to perform corrections for color difference and position difference in a color laser printer.

2) Description of the Related Art

In general, a color electrophotographic printer has peripherals for each of a plurality of photosensitive drums and sequentially transfers images of cyan, magenta, yellow, and black on each photosensitive drum onto a transfer paper to obtain a color image. As disclosed in Japanese Patent Application Laid-open Publication No. 07-199576, a technique for correcting color difference is well known for the color electrophotographic printer In the conventional technique, fluctuated image data due to mechanical fluctuations is measured on the transfer belt to obtain color difference data, based on which correction timing data for enabling a color-difference-corrected optical writing is created. Based on the correction timing data, an optical writing device is operated to perform a writing.

However, the belt speed changes due to a deviation of two transfer belt rollers, and even if the angular velocity of rotation is constant, the transport speed changes resulting from a change in thickness in each portion of the transfer belt. The transport speed of the transfer belt is unique to each transfer belt unit. Therefore, when the transfer belt unit is replaced, since an error such as color difference takes place, the quality of the output color image may deteriorate, as compared with the quality before replacing the transfer belt unit.

SUMMARY OF THE INVENTION

It is an object of the present invention to at least solve the problems in the conventional technology.

The color laser printer according to one aspect of the present invention includes a detachable transfer belt unit having a data storage unit that stores color correction data and position correction data, a detecting unit that detects whether the transfer belt unit is detached and reattached or replaced with another transfer belt unit with the same configuration, and a correcting unit that performs corrections for color difference and position difference based on the color correction data and the position correction data stored in the data storage unit when the detecting unit detects that the transfer belt unit is detached and reattached or replaced with another transfer belt unit with the same configuration.

The color laser printer according to another aspect of the present invention includes a detachable transferring means having a storage means that stores color correction data and position correction data, a detecting means that detects whether the transferring means is detached and reattached or replaced with another transferring means with the same configuration, and a correcting means that performs corrections for color difference and position difference based on the color correction data and the position correction data stored in the storage means when the detecting means detects that the transferring means is detached and reattached or replaced with another transferring means with the same configuration.

The color laser printer according to still another aspect of the present invention utilizes a method of correcting color difference and position difference based on color correction data and position correction data when a transfer belt unit is detached and reattached or replaced with another transfer belt unit with the same configuration, wherein the color laser printer has a detachable transfer belt unit with a data storage unit that stores the color correction data and the position correction data.

The other objects, features and advantages of the present invention are specifically set forth in or will become apparent from the following detailed descriptions of the invention when read in conjunction with the accompanying drawings.

DETAILED DESCRIPTION

Exemplary embodiments of the color laser printer of the present invention will be explained with reference to the drawings.

Figure 1:
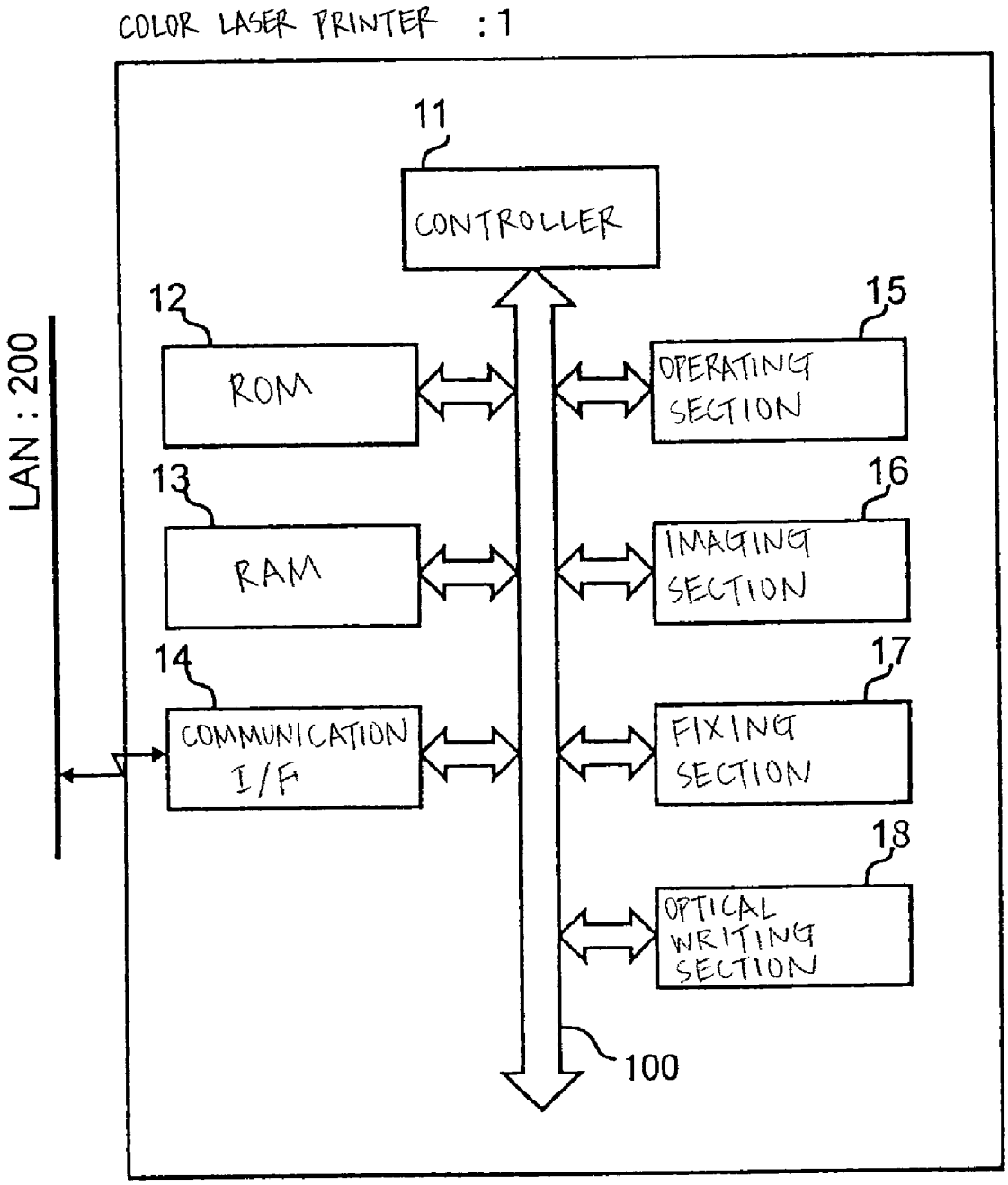
FIG. 1 is a block diagram of a color laser printer according to the present invention.

FIG. 1 is a block diagram of a color laser printer 1 according to the present invention. The color laser printer 1 comprises a controller 11, a ROM (read only memory) 12, a RAM (random access memory) 13, a communication I/F (interface) 14, an operating section 15, an imaging section 16, a fixing section 17, and an optical writing section 18.

The controller 11 includes a CPU (central processing unit), and controls each constituent (denoted by reference numerals 12 to 18) via a bus 100.

The ROM 12 stores a system program, a driver and the like for controlling the respective sections in the color laser printer 1, and fixed parameters are set therein.

The RAM 13 is backed up by batteries, and stores user setting for the color laser printer.

The communication I/F 14 is connected to a host computer or the like via a LAN (local area network), a communication cable, or the like (LAN 200 in FIG. 1), and can download printing data from the host computer or the like.

The operating section 15 is a user interface for the color laser printer 1, and a user can perform various setting and operation, using the operating section 15.

Figure 2:
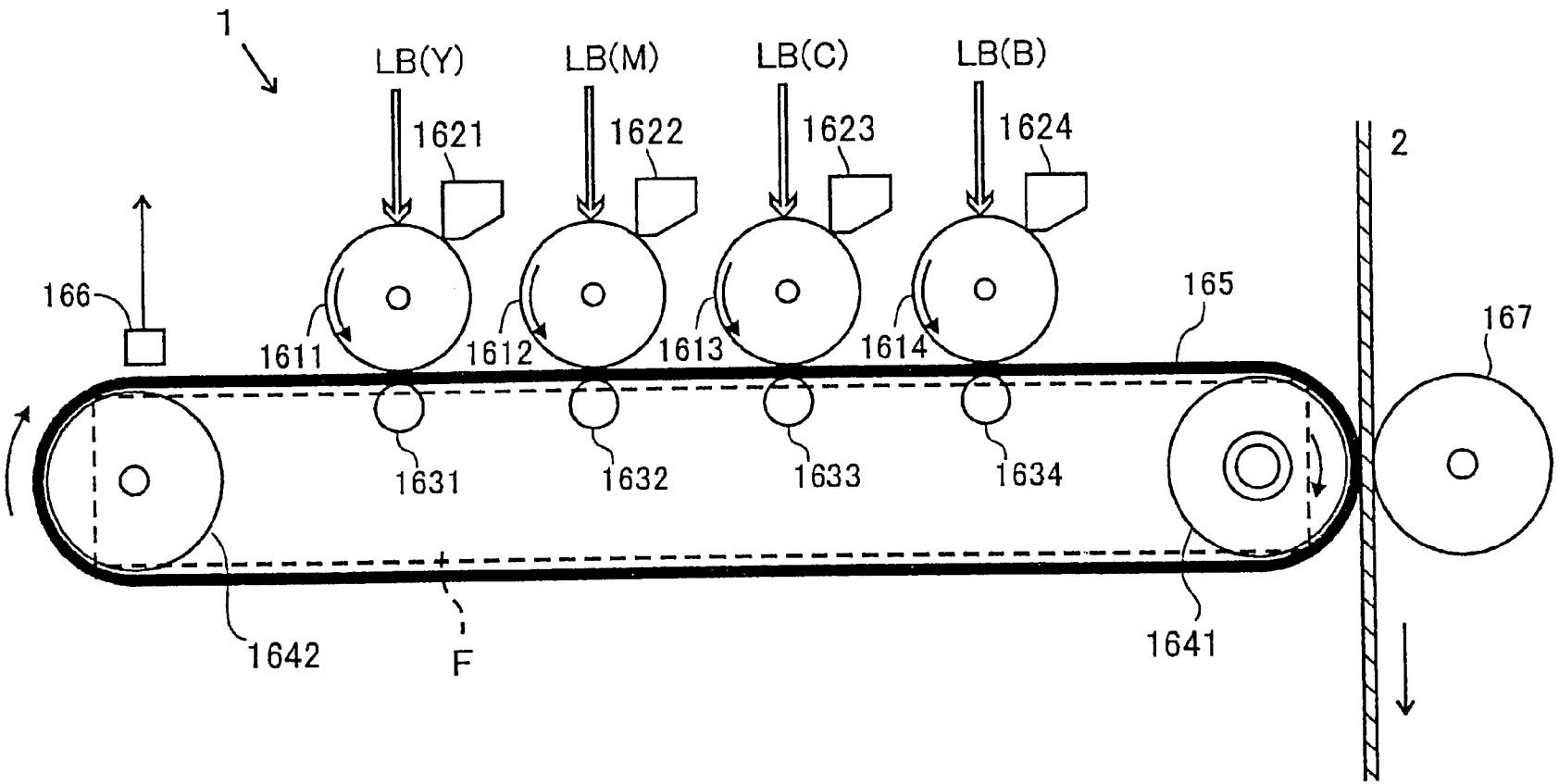
FIG. 2 is a schematic diagram of a printing section of the color laser printer.

The imaging section 16 comprises, as shown in FIG. 2, photosensitive drums 1611 to 1614, toner tanks 1621 to 1624 that supplies four color (yellow (Y), magenta (M), cyan (C), and black (B)) toners to the respective drums, and a transfer belt unit (VU) (including a transfer belt 165 and a sensor 166).

The fixing section 17 performs fixation of an image secondarily transferred onto the transfer paper (printing paper).

The optical writing section 18 irradiates laser beams to the respective photosensitive drums 1611 to 1614 using laser diodes so as to adjust a portion where the toner is adhered on the respective photosensitive drums, thereby forming an image on the photosensitive drums based on an electrostatic charge.

As shown in FIG. 2, the imaging section 16 includes the photosensitive drums 1611 to 1614, toner tanks 1621 to 1624 in which yellow (Y), magenta (M), cyan (C), and black (B) toners are stored, primary transfer rollers 1631 to 1634, a drive transfer belt roller 1641, a driven transfer belt roller 1642, an endless transfer belt 165, a reference point detection sensor 166, and a secondary transfer roller 167. The respective rollers are supported by a frame F, and an EEPROM (electrically erasable programmable read-only memory) is attached to the frame F.

When printing an image, an electric charge is uniformly applied onto the surfaces of the photosensitive drums 1611 to 1614 by an electric charge applying section (not shown in the figure). Laser beams LB (Y), LB (M), LB (C), and LB (B) are irradiated to the drum surfaces from a laser light source (corresponding to the optical writing section 18 shown in FIG. 1). Toners supplied from the toner tanks 1621 to 1624 adhere to the portion on the photosensitive drums 1611 to 1614, from which the electric charge has been removed by the laser beams LB (Y), LB (M), LB (C), and LB (B).

Images of the yellow, magenta, cyan, and black components are respectively formed by the yellow, magenta, cyan, and black toners adhered on the respective drums. These images are sequentially transferred to the transfer belt 165 by the primary transfer rollers 1631 to 1634, to form a toner image on the transfer belt. Further, the color image on the transfer belt 165 is transferred to the transfer paper (printing paper) by the secondary transfer roller 167.

The drive transfer belt roller 1641 carries the transfer belt 165 at a constant speed (at a speed synchronized with the rotation speed of the photosensitive drums 1611 to 1614).

Figure 3:
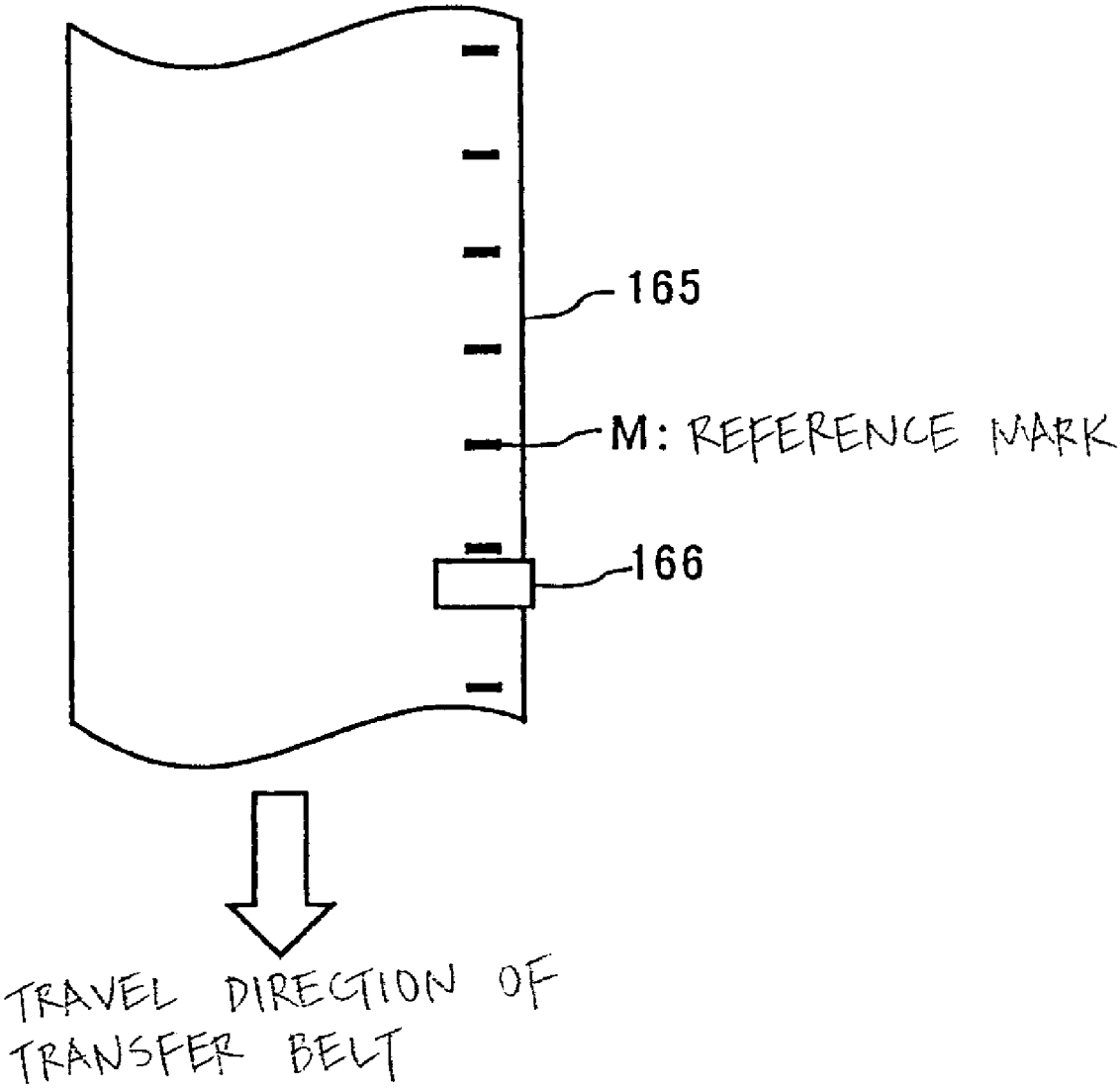
FIG. 3 is an illustration of reference marks on a transfer belt.

As shown in FIG. 3, a plurality of reference marks M is added on the outside surface of the transfer belt 165. A sensor 166 is also illustrated in FIG. 3.

The transfer belt unit VU includes the primary transfer rollers 1631 to 1634 and transfer belt rollers 1641 and 1642, and in the embodiment, also includes an EEPROM.

As the main cause for the occurrence of position difference or color difference, precision of parts in the imaging section 16, precision of parts in the optical writing section 18, a variation in size due to expansion and contraction by the environment can be considered.

In the color laser printer, correction of color difference and position difference is conducted as described in Japanese Patent Application Laid-open Publication No. H7-199576.

In the transfer belt unit VU, the transport speed changes resulting from a deviation of the drive transfer belt roller 1641 and the driven transfer belt roller 1642 of the transfer belt rollers. Even if the angular velocity of the rotation of the drive transfer belt roller 1641 and the driven transfer belt roller 1642 is constant, the transport speed changes due to a change in thickness in each portion of the transfer belt 165.

The transport speed of the transfer belt is peculiar to each transfer belt unit VU, and according to the present invention, a parameter based on the transport speed can be designated as the correction data for position difference and color difference when the transfer belt unit is fitted to the apparatus.

In the embodiment, as the correction data, the following correction data is obtained, prior to the factory shipment of the transfer belt unit VU for replacement, or prior to incorporation of the transfer belt unit VU in the color laser printer 1 in the factory.

At first, the transfer belt 165 is divided into N blocks perpendicularly to the travel direction. As shown in FIG. 3, the drive transfer belt roller 1641 is driven for N blocks on the transfer belt, at the same drive speed as that of when the belt roller is mounted on a machine.

At the time of factory shipment of the transfer belt unit VU for replacement, an EEPROM in which the measurement data (or correction data based on the measurement data) is written is built in the transfer belt unit VU to be shipped, and correction setting is performed at the time of replacement of the transfer belt unit VU in the color laser printer 1.

When the transfer belt unit VU is incorporated in the color laser printer 1 in the factory, correction setting based on the measurement data (or correction data based on the measurement data) is performed.

For example, in the measurement prior to the factory shipment, when the time until the transfer belt 165 makes a turn is denoted by T, it is assumed that an average speed in the first block after the reference point M has passed the sensor 166 is v1, an average speed in the next block is v2, . . . , to obtain N average speed data. As a result, N speed data v1, v2, . . . , and vN can be obtained.

The correction data is written for example in the ROM 12. When the correction data is written in the ROM 12, the ROM 12 is a rewritable ROM such as an EEPROM. The correction data can be written in a rewritable ROM other than the ROM 12.

Figure 4:
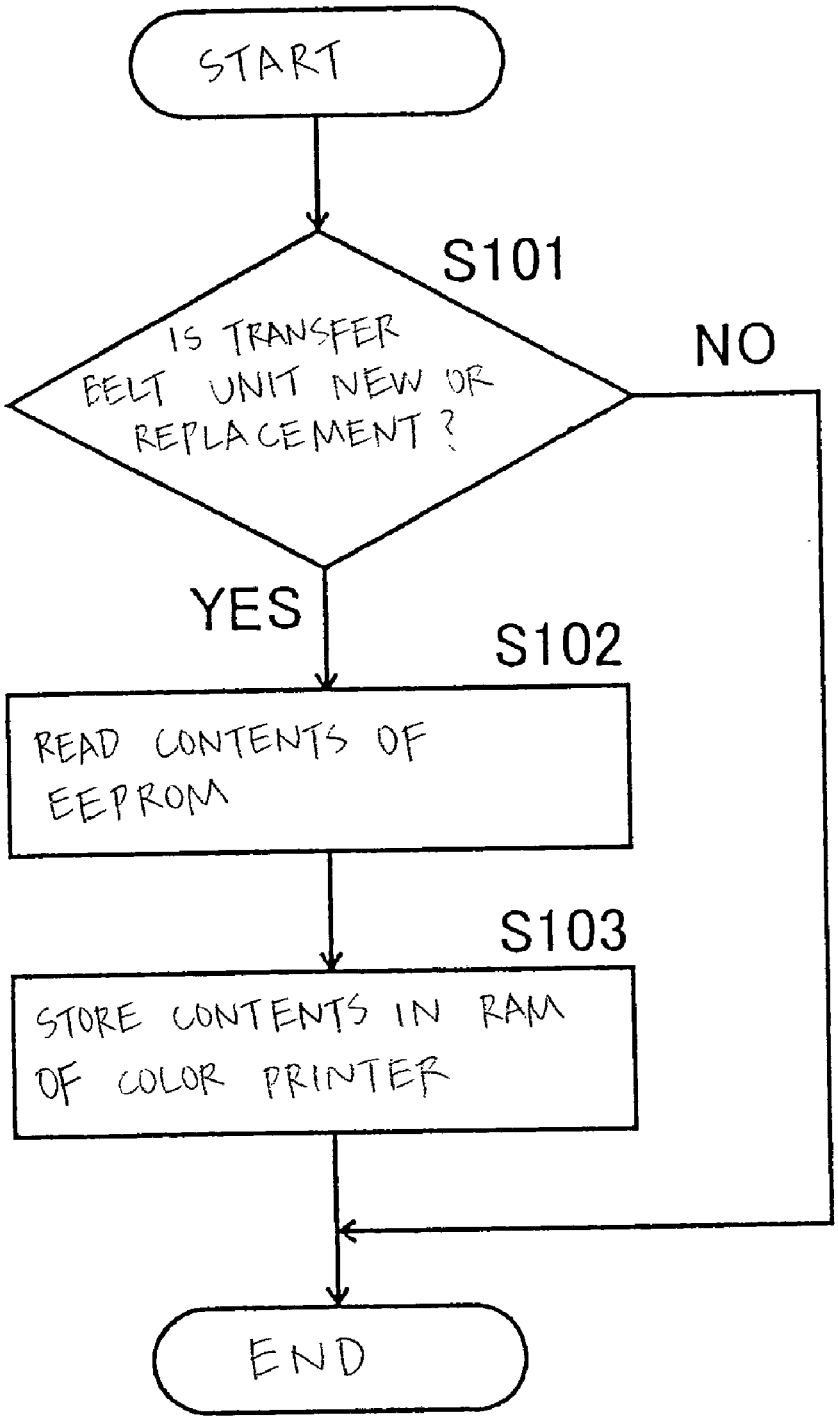
FIG. 4 is a flowchart of a processing procedure when transferring correction data recorded on an EEPROM (electrically erasable programmable read-only memory) to a RAM (random access memory)

A method of inputting the correction data stored in the EEPROM into the RAM 13 will be explained, with reference to the flowchart in FIG. 4.

When the transfer belt unit VU having the EEPROM mounted thereon is attached, the processing is terminated at the time of detachment for maintenance or the like ("NO" at S101). When the transfer belt unit VU is attached to the apparatus due to new assembly or replacement ("YES" at S101), the controller 11 reads the correction data written in the EEPROM in the transfer belt unit VU (S102), and writes the correction data in the RAM 13 (S103), to finish the processing.

Figure 5:
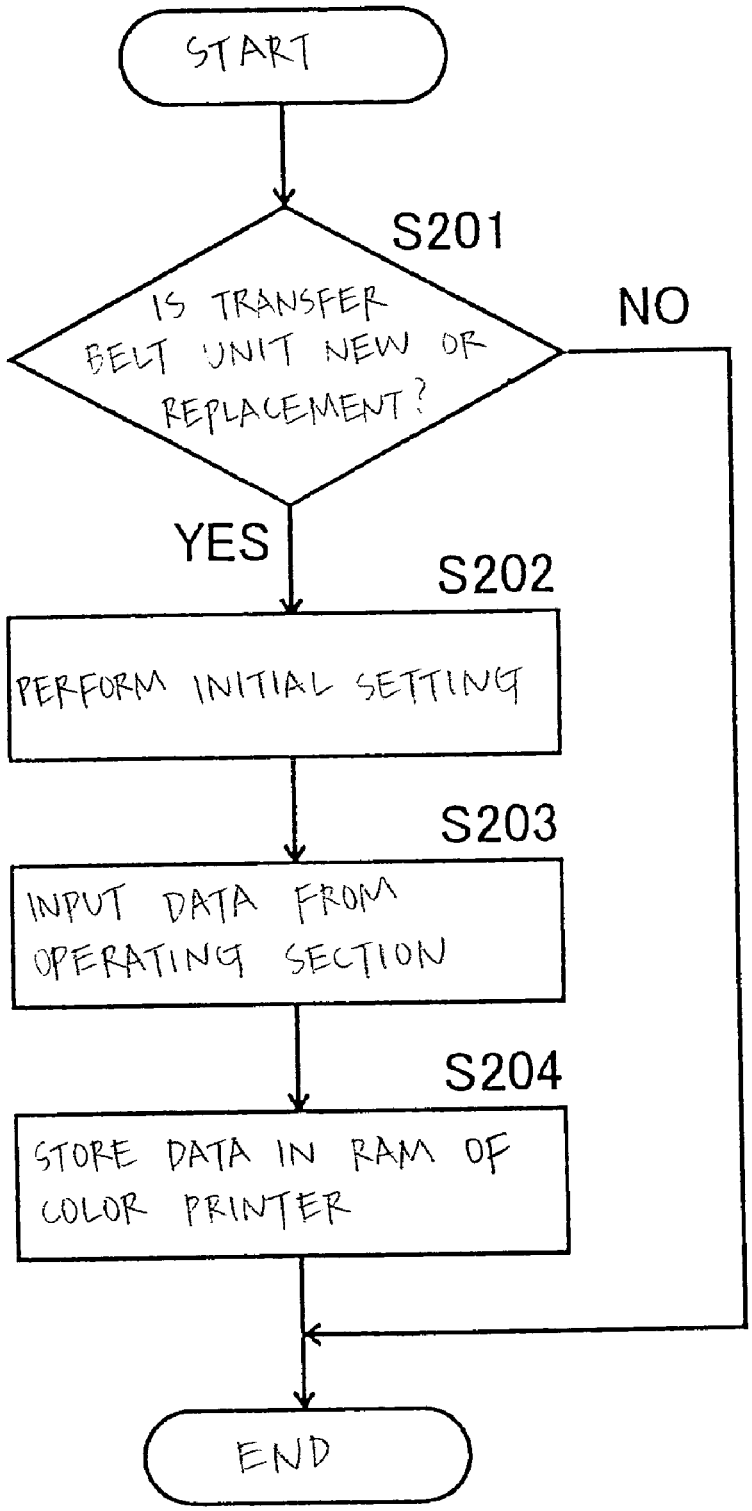
FIG. 5 is a flowchart of a processing procedure when manually writing correction data into the RAM.

A method of inputting the correction data by the operating section will be explained, with reference to the flowchart in FIG. 5. When the transfer belt unit VU is attached, the processing is terminated at the time of detachment for maintenance or the like ("NO" at S201). When the transfer belt unit VU is attached to the apparatus due to new assembly or replacement ("YES" at S201), setting of the apparatus is shifted to the initial setting mode, at the time of replacement of the transfer belt unit VU (S202). The correction data added to the transfer belt unit VU is input from the operating section (S203). The controller 11 rewrites and stores the input data in the RAM 13 as the correction data (S204), to finish the processing.

By writing in the RAM the data for correcting position difference and color difference resulting from the transfer belt unit and the information added to the transfer belt, useless consumption of toner due to the adjustment operation for the position difference and color difference correction and the adjusting time for correction can be saved.

Further, by storing the correction data in the EEPROM, when the transfer belt unit is assembled or replaced, the CPU (controller) can read the information recorded in the EEPROM, and transfer the data to the RAM or the like, so that the correction data can be easily written in the RAM.

Since the correction data includes all the causes of the position difference and color difference resulting from the constituents in the transfer belt unit, it is not necessary to perform correction of the respective constituents separately, thereby enabling efficient correction.

Further, the correction data can be written in the RAM manually from the operation panel or the like. By storing the information such as the manufacturing number of the transfer belt unit in a predetermined server on the network, the correction data can be downloaded and written in the RAM based on the information, at the time of new assembly or replacement thereof.

The present document incorporates by reference the entire contents of Japanese priority document, 2002-275659 filed in Japan on Sep. 20, 2002.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus for correcting color difference and position difference based on a unique correction data related to a transfer belt unit, the image forming apparatus comprising:

a controller configured to read the unique correction data and manufacturing information of the transfer belt unit stored in a first memory contained in the transfer belt unit connected to a main body of the image forming apparatus, and configured to download the unique correction data from a server on the internet to the second memory by using the manufacturing information, and configured to transfer the unique correction data from the first memory to a second memory contained in the main body of the image forming apparatus; and a correction control unit configured to correct the color difference and position difference based on the unique correction data stored in the second memory, wherein the unique correction data includes an average velocity value of a rotation of the transfer belt based on multiple velocity measurements made along the rotation of the transfer belt.

2. The image forming apparatus according to claim 1, wherein the unique correction data is stored in the first memory prior to incorporation of the transfer belt unit into the main body of the image forming apparatus.

3. The image forming apparatus according to claim 1, wherein the average value of the unique correction data is calculated based on multiple measurements of passages times of plural reference marks on the transfer belt.

4. The image forming apparatus according to claim 1, wherein the controller is configured to transfer the correction data stored in the first memory to the second memory when the transfer belt unit is detached and reattached or replaced with another transfer belt unit.

5. The image forming apparatus according to claim 1, wherein the transfer belt is provided with plural reference marks fixedly pre-formed on the transfer belt.

6. The image forming apparatus according to claim 5, further comprises:

a mark detector configured to detect the reference marks on the transfer belt, and output a mark detection signal upon detection of the reference marks;

a plurality of photosensitive drums provided in contact with the transfer belt;

a plurality of toner tanks each of which is configured to supply toner to a corresponding photosensitive drum; and a plurality of laser optical systems each of which is configured to form an image on a corresponding photosensitive drum upon output of the mark detection signal.

7. The image forming apparatus according to claim 6, wherein the transfer belt is an endless track forming a loop, and the transfer belt unit further comprises:

a driving roller provided at one end and inside of the loop of the transfer belt and configured to drive the transfer belt, and a following roller provided at anther end and inside of the loop of the transfer belt and configured to follow the driving roller; and a plurality of primary transfer rollers provided inside of the loop of the transfer belt, each of which is configured to press the transfer belt towards a corresponding photosensitive drum.

8. The image forming apparatus according to claim 1, wherein the transfer belt is an endless track forming a loop, and the transfer belt unit further comprises a driving roller provided at one end and inside of the loop of the transfer belt and configured to drive the transfer belt, and the image forming apparatus further comprises a printing control system provided with the data storage unit and configured to control the driving roller to adjust a speed of the transfer belt based on the correction data transferred to the data storage unit.

9. The image forming apparatus according to claim 1, wherein the first memory comprises an electronically erasable and programmable read only memory.

* * * * *